US011230403B2

(12) United States Patent
Valencia

(10) Patent No.: US 11,230,403 B2
(45) Date of Patent: Jan. 25, 2022

(54) CARRIER AND BLANK THEREFOR

(71) Applicant: WestRock Shared Services, LLC, Atlanta, GA (US)

(72) Inventor: John Valencia, Johns Creek, GA (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

(21) Appl. No.: 16/943,171

(22) Filed: Jul. 30, 2020

(65) Prior Publication Data

US 2021/0031966 A1 Feb. 4, 2021

Related U.S. Application Data

(60) Provisional application No. 62/881,574, filed on Aug. 1, 2019.

(51) Int. Cl.
*B65D 5/02* (2006.01)
*B65D 5/36* (2006.01)
(Continued)

(52) U.S. Cl.
CPC ..... *B65D 5/029* (2013.01); *B65D 5/106* (2013.01); *B65D 5/3628* (2013.01); *B65D 5/46096* (2013.01)

(58) Field of Classification Search
CPC ..... B65D 5/029; B65D 5/106; B65D 5/3628; B65D 5/46096; B65D 5/3621; B65D 5/008; B65D 5/2028
(Continued)

(56) References Cited

U.S. PATENT DOCUMENTS 2,996,234 A * 8/1961 Wheeler ..... B65D 5/3614 229/115
3,185,378 A * 5/1965 Rosenburg ..... B65D 5/0254 229/115
(Continued)

FOREIGN PATENT DOCUMENTS

GB 1980-J1563 C * 4/1976
GB 1980-J1563 C * 7/1976

*Primary Examiner* — Christopher R Demeree
(74) *Attorney, Agent, or Firm* — Brian J. Goldberg; Neil G. Cohen

(57) ABSTRACT

Aspects of the invention are directed toward a carrier (90) for containing a product. The carrier comprises first, second and third connected side panels (16*a*/16*b*, 116*a*/116*b*, 216*a*/216*b*, 316*a*/316*b*; 14, 114, 214, 314; 12, 112, 212, 312) which define a three-sided tubular structure having a triangular cross-section. The carrier has a substantially triangular-shaped, crash-bottom-style, bottom wall. Parts (24*b*/26*b*, 20*b*/32, 22*b*; 124*b*/126*b*, 120*b*/132, 122*b*; 224*b*/226*b*, 220*b*/232, 222*b*; 324*b*/326*b*, 320*b*/332, 322*b*) of the bottom wall are coupled to the first, second and third side panels. The carrier has a mechanical interlocking feature (T1, T2, S1, S2); and a multi-part mechanical locking mechanism. A first top-end closure panel (16*a*/16*b* 116*a*/116*b*; 215*a*/215*b*; 315*a*/315*b*) comprises a first part (A1) of said multi-part mechanical locking mechanism. A second top-end closure panel (20*a*; 120*a*; 220*a*; 320*a*) and a first handle panel (34; 134; 234; 334) coupled thereto, comprise a second part (N2; 334) of the multi-part mechanical locking mechanism; and a third top end closure panel (22*a*; 122*a*; 222*a*; 322*a*) and a second handle panel (36; 136; 236; 336) coupled thereto, comprise a third part (N1; 336) of said multi-part mechanical locking mechanism.

19 Claims, 15 Drawing Sheets

(51) Int. Cl.
*B65D 5/46* (2006.01)
*B65D 5/10* (2006.01)

(58) Field of Classification Search
USPC ..... 229/108.1, 117, 115, 117.14, 116; 206/170
See application file for complete search history.

(56) References Cited

U.S. PATENT DOCUMENTS 3,295,740 A * 1/1967 Hall ..... B65D 5/0254 206/486
3,482,760 A * 12/1969 Boehm ..... B65D 5/0254 229/115
4,269,348 A * 5/1981 Young ..... B65D 5/4616 229/115
5,125,565 A * 6/1992 Rogers ..... B65D 5/60 229/115
10,556,716 B2 * 2/2020 Ramos ..... A61B 50/20

* cited by examiner

CARRIER AND BLANK THEREFOR

CROSS-REFERENCE TO RELATED APPLICATIONS

This claims the benefit of U.S. Provisional Patent Application No. 62/881,574, filed Aug. 1, 2019, which is incorporated herein by reference in its entirety.

TECHNICAL FIELD

The present invention relates to a carrier and to a blank for constructing a carrier, more specifically to a carrier for a hot or cold, food or beverage type products, having a three-sided tubular structure with a triangular cross-sectional shape; and a carrying handle.

BACKGROUND

In the field of packaging it is known to provide cartons for holding take-away food items such as but not limited to freshly baked goods, cakes, pastries, bagels, buns and the like. Cartons are well known in the art and are useful for enabling consumers to transport and access a food item for consumption. For cost and environmental considerations, such cartons or carriers need to be formed from as little material as possible and cause as little wastage in the materials from which they are formed as possible. Further considerations are the strength of the carton and its suitability for holding and transporting the item. It is desirable that the contents of the carton are retained within the carton. It is typical for such take-away food carriers to be made from plastic or polystyrene and it is desirable to move away from such materials and use recyclable, biodegradable, sustainably-sourced materials. Paper-based materials are a good choice for meeting these requirements, but when a thin, or low-grade paper-based material is used to form a box or carrier, the box can be weak, far less rigid than a plastic container, and in very simple cake-box type structures can sometimes flop-open. It is desirable to provide a carrier that can be more eco-friendly than a plastic container; and yet be sufficiently strong and rigid for protecting delicate items such as cakes and pastries. Furthermore, it is desirable for the carrier to be erectable from a blank of material using automated gluing and folding machinery. It is an object of the present disclosure to enable a blank to be assembled into a flat collapsed carrier, such that the costs of transport to take-away food outlets and storage of a supply of flat collapsed carriers is minimized. Furthermore, it is desirable to simplify construction of a flat-form part constructed carrier, into a fully opened and assembled carton, so that when a consumer is being served at a take-away food outlet, the speed and quality of service offered to them is not compromised by a long delay while the server painstakingly assembles a carrier that requires a complicated-series of assembly steps; an especially dexterous server; and/or some form of adhesive means such as sticky-tape.

The present invention seeks to provide an improvement in the field of cartons, typically formed from paperboard or the like.

SUMMARY

A first aspect of the present disclosure provides a carrier for a food or beverage product. The carrier comprises first, second and third connected side panels which together define a three-sided tubular structure having a triangular cross-sectional shape. The carrier may further comprise:

(i) A substantially triangular-shaped, crash-bottom-style, bottom wall for supporting one or more food or beverage products when contained in the carrier. A part of the bottom wall may be coupled directly to each of the first, second and third side panels.

(ii) A mechanical interlocking feature for maintaining the bottom wall in a set-up condition.

(iii) A multi-part mechanical locking mechanism.

(iv) A first top-end closure panel comprising a first part of said multi-part mechanical locking mechanism.

(v) A second top-end closure panel and a first handle panel, comprising a second part of said multi-part mechanical locking mechanism.

(vi) A third top end closure panel and a second handle panel coupled thereto, comprising a third part of said multi-part mechanical locking mechanism.

Upon interconnection of said first, second and third parts of the multi-part mechanical locking mechanism, a top-end of the carrier is releasably secured into a closed and locked condition; and upon disconnection of said first, second and third parts of the multi-part mechanical locking mechanism, the carrier is released into an open-topped condition wherein access to the interior of the carrier is gained.

Optionally, the bottom wall comprises: a first bottom-end closure panel hinged to the first side panel; a second bottom-end closure panel hinged to the second side panel; and a third bottom-end closure panel hinged to the third side panel.

Optionally, the third bottom-end closure panel is disposed outermost and the second bottom-end closure panel is folded such that first and second sections of the second bottom-end closure panel overlay at least part of the third bottom-end closure panel. The second section may be affixed to the third end closure panel; and the first bottom-end closure panel may be disposed innermost and overlays at least part of the second and third bottom-end closure panels.

Optionally, a first part of said mechanical interlocking feature for maintaining the bottom wall in a set-up condition is provided by a first slot formed proximate to, or within, a hinged connection between the second bottom-end closure panel and the second side panel.

Optionally, said first bottom-end closure panel has a generally triangular shape having a base defined by a hinged connection between the first bottom-end closure panel and the first side panel. A first upstand flap may be connected to a first edge of the first bottom-end closure panel.

Optionally, a second part of the mechanical interlocking feature for maintaining the bottom wall in a set-up condition is provided by a first tab formed proximate to a hinged connection between the first bottom-end closure panel and the first upstand flap.

Optionally, the first tab is engaged with the first slot and the first upstand flap is disposed in face contacting relationship with an inside surface of the second side panel.

Optionally, a third part of said mechanical interlocking feature for maintaining the bottom wall in a set-up condition is provided by a second slot formed proximate to or within a hinged connection between the second bottom-end closure panel and the second side panel.

Optionally, a second upstand flap is connected to a second edge of said first bottom-end closure panel.

Optionally, a fourth part of said mechanical interlocking feature for maintaining the bottom wall in a set-up condition is provided by a second tab formed proximate to a hinged connection between the first bottom-end closure panel and the second upstand flap.

Optionally, said second tab is engaged with the second slot and wherein the second upstand flap is disposed in face contacting relationship with an inside surface of the third side panel.

Optionally, said first part of the multi-part mechanical locking mechanism comprises an aperture. The second part of the multi-part mechanical locking mechanism may comprise a hooked portion formed as an appendage to the second top-end closure panel. The third part of the multi-part mechanical locking mechanism may also comprise a hooked portion formed as an appendage to the third top-end closure panel.

Optionally, a first retention feature for retaining an ancillary item is provided as a pocket. The pocket may be defined by: a first pocket panel hingedly connected to the second top-end closure panel; a second pocket panel hingedly connected to the second side panel; and a third pocket panel hinged between the first and second pocket panels. The first pocket panel may provide a back wall of a pocket and the second pocket panel may form a bottom wall of the pocket.

Optionally, the first pocket panel is generally trapezoidal in shape, with tapered edges. A recess provided along an edge of the first top end closure panel may have a similar shape and size to the shape and size of the first pocket panel.

In some arrangements, to facilitate the formation of a flat-form collapsed carrier, the first side panel and its associated first bottom-end closure panel comprise a medial fold line.

According to another aspect of the disclosure for which protection is sought, there is provided a blank for forming a carrier suitable for containing a food or beverage product. The blank may comprise first, second and third side panels for forming a three-sided tubular structure having a triangular cross-sectional shape. The blank may further comprise:

(i) First, second and third bottom-end closure panels for forming a substantially triangular-shaped, crash-bottom-style, bottom wall, said first, second and third bottom-end closure panels being directly coupled to the first, second and third side panels respectively.

(ii) Features for forming a mechanical interlocking feature for maintaining the bottom wall in a set-up condition.

(iii) Features for forming a multi-part mechanical locking mechanism.

(iv) A first top-end closure panel comprising a first part of said multi-part mechanical locking mechanism.

(v) A second top-end closure panel and a first handle panel coupled thereto, comprising a second part of said multi-part mechanical locking mechanism.

(vi) A third top end closure panel and a second handle panel coupled thereto, comprising a third part of said multi-part mechanical locking mechanism. Upon assembly of the blank into a carrier and upon interconnection of said first, second and third parts of the multi-part mechanical locking mechanism, a top-end of the carrier is releasably secured into a closed and locked condition; and upon disconnection of said first, second and third parts of the multi-part mechanical locking mechanism, the carrier is released into an open-topped condition wherein access to the interior of the carrier is gained.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the carriers, blanks and collapsed carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the carriers, blanks and collapsed carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
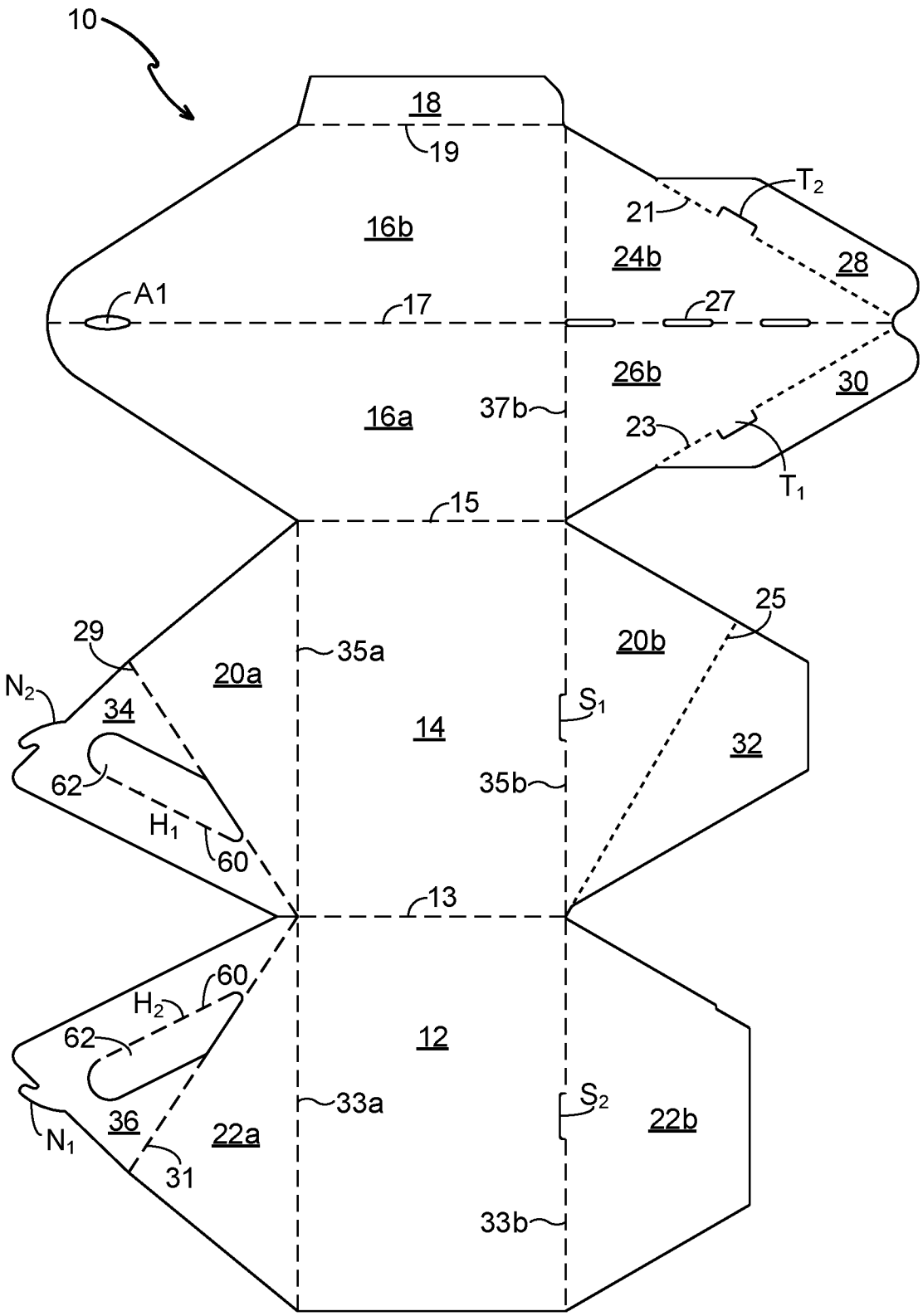
FIG. 1 is a plan view from above of a blank for forming a carrier according to an embodiment of the disclosure.
Figure 11:
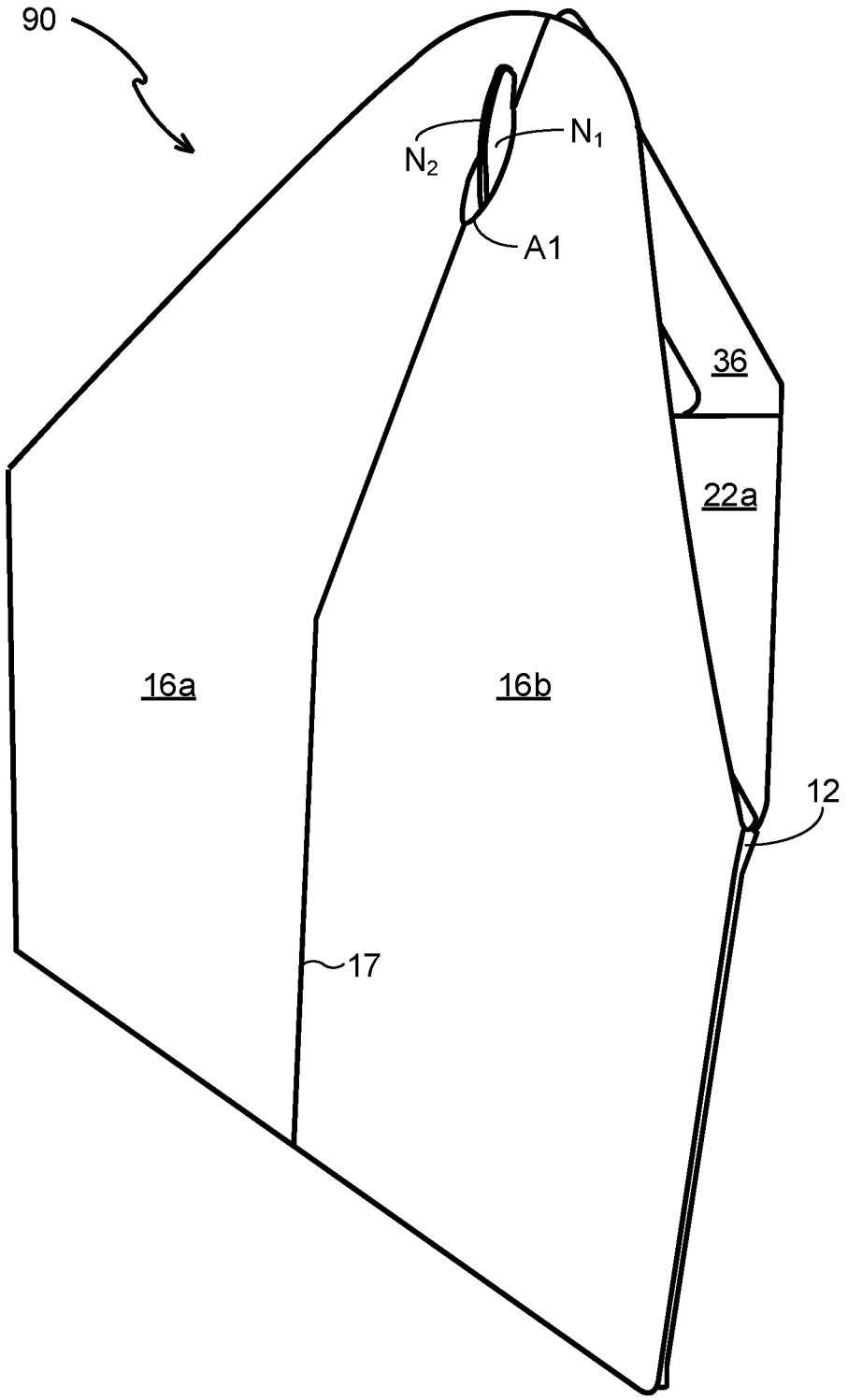
FIGS. 11 and 12 are both perspective views from above of an assembled carrier in a closed condition.
Figure 12:
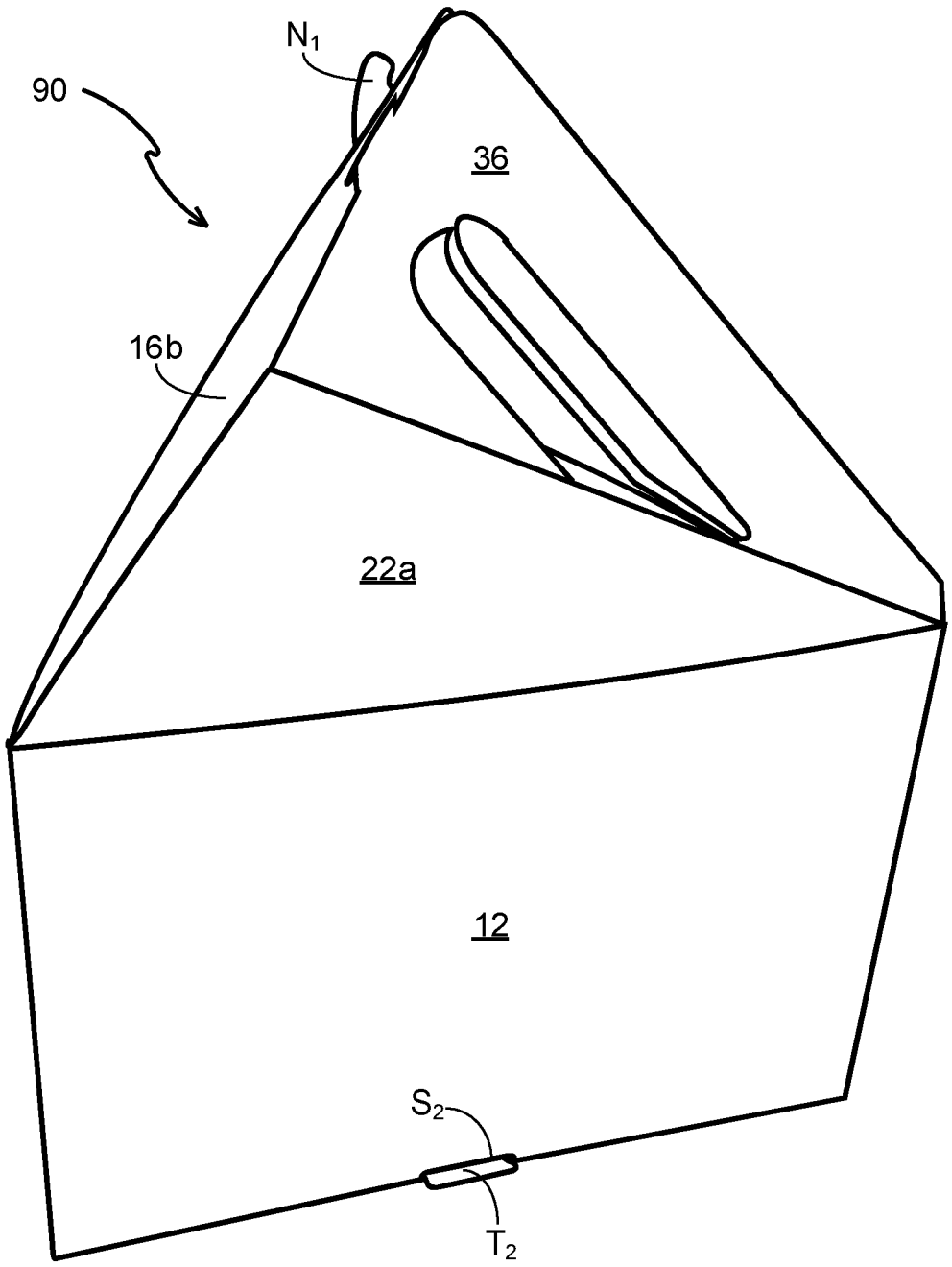

Referring to FIG. 1, there is shown a plan view of a blank 10 capable of forming a top-opening, reclosable carton or carrier 90, as shown in FIGS. 11 and 12, for holding a product such as, but not limited to, a food item or combination of food items for example, but not limited to, freshly baked goods, cakes, pastries, bagels, buns and the like. The carton 90 may be used as a disposable or re-usable food carton for securely and safely containing food or beverage items for convenient transport from a take-away food establishment such as a coffee shop, bakery, deli, sandwich shop, salad bar and the like, directly by a consumer or indirectly by a food-delivery service. In one of a huge variety of applications, the carrier 90 is particularly beneficial for the containment and carrying of freshly baked bagels, which are, at least to some degree, protected from being damaged, during transport due to collision with inside walls of the carrier (which can occur with known cake-carriers), by the triangular structure of the carrier. It will be recognized that a carrier 90 of the present disclosure may also be suitable for containing and carrying warm or hot, and/or moist items, such as hot food (burgers, fries, noodles), coffee, soup, dressed-salads and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of, or coated with, materials to increase its strength, tear resistance or moisture resistance. Examples of such sheet material are PrintKote® Poly paperboard and CustomKote™ Poly paperboard made by WestRock Company. It should be noted that the resistant materials may be provided by more than one layer, to help improve the moisture or tear resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of moisture resistance, tear-resistance, good glue-ability, heat sealability, or other desired functional properties.

The blank 10 may include a paperboard substrate and may also include a moisture resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 14-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The moisture resistant layer may be disposed over the uncoated side of the paperboard substrate and may be formed of polymeric material and secured to the substrate. The moisture resistant layer imparts toughness to the laminate structure. The moisture resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear or moisture resistance may also be used.

The adhesive layer may be formed of polyolefin material such as a low-density polyethylene (LDPE). The adhesive layer may be placed between the substrate and the tear/moisture resistant layer to secure the tear/moisture resistant layer to the substrate.

Suitable tear/moisture resistant materials may include, but not be limited to, tear resistant laminated sheet material, e.g., NATRALOCK® paperboard made by WestRock Company, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Figure 10:
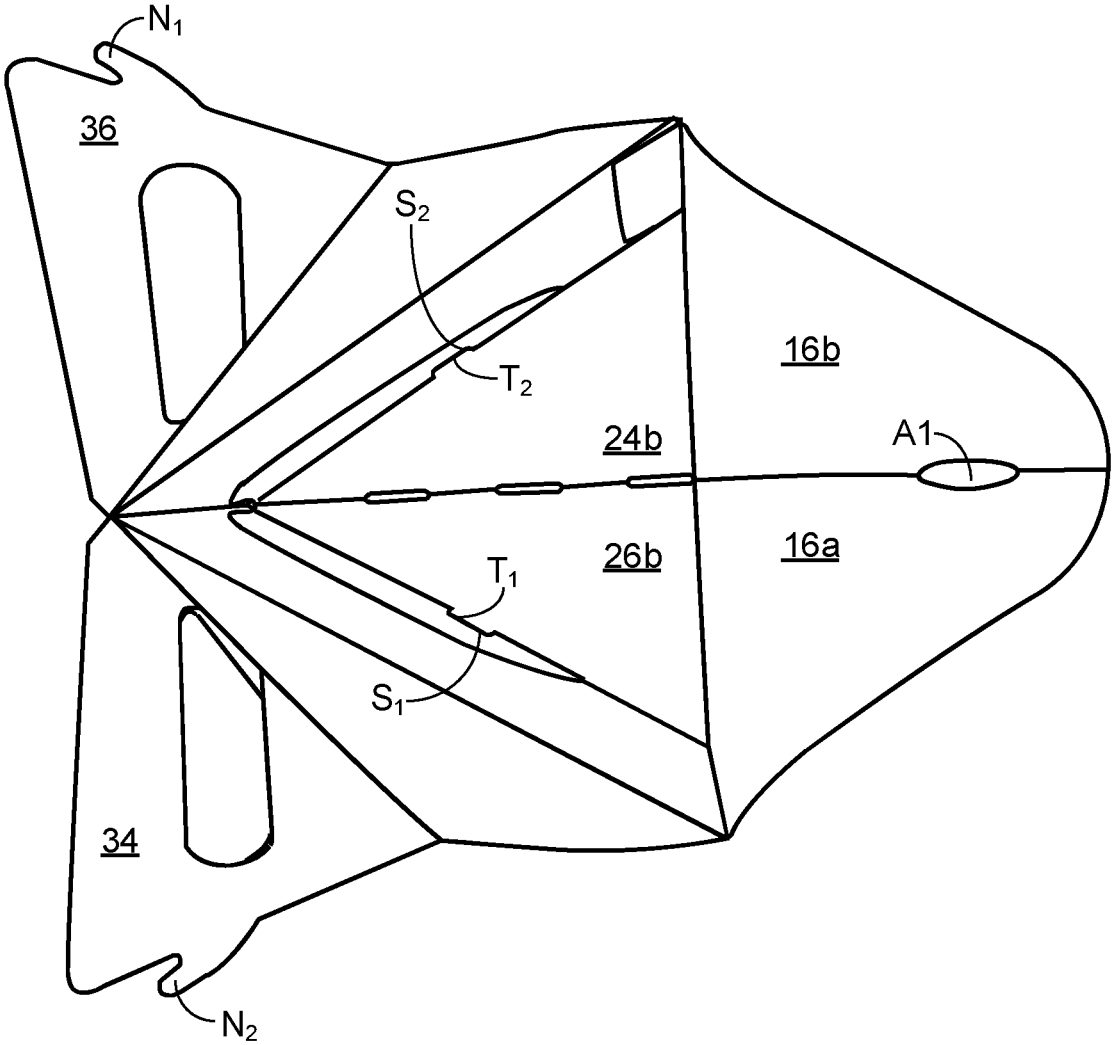

As shown in FIGS. 10 and 11 (and apparent from blank 10 of FIG. 1), the carrier 90 has a three-sided (12, 14, 16*a*/16*b*) tubular structure and a generally triangular cross-sectional shape. The carrier 90 has a substantially triangular-shaped, composite, crash-bottom-style, bottom wall 24*b*/26*b*/20*b*/32/22 of solid construction to ensure that items, when contained in the carrier 90 are well supported, securely contained and protected against accidental egress.

In the embodiments detailed herein, the terms "carton" and "carrier" refer, for the non-limiting purpose of illustrating the various features of the invention, to a container for engaging and carrying a product. It is contemplated that the teachings of the invention can be applied to various products.

Referring to FIG. 1, it can be seen that the blank 10 comprises: a first side panel 16*a*/16*b*; a second side panel 14; and a third side panel 12. The first, second and third side panels 16*a*/16*b*, 14, 12 are hinged one to the next in a linear series by means of fold lines 15 and 13.

A glue panel or securing panel 18 is provided for affixing the first and third side panels 16*a*/16*b*, 12 together such that a carrier 90 having a triangular and tubular structure can be formed. The securing panel 18 may be affixed to any suitable panel within the blank 10 structure, preferably either of the first or third side panels 16*a*/16*b*, 12. In the illustrated arrangement shown in FIG. 1, the securing panel 18 is hingedly connected to the first side panel 16*a*/16*b* by a fold line 19. In the blank 310 of FIG. 15, it can be seen that the securing panel 318 in that arrangement is affixed to the third panel 312.

The substantially triangular-shaped, composite, crash-bottom-style, bottom wall 24*b*/26*b*/20*b*/32/22 is formed from a series of three bottom-end closure panels 24*b*/26*b*, 20*b*/32, 22. A first bottom-end closure panel 24*b*/26*b* has a generally triangular shape and is hinged to the first side panel 16*a*/16*b* by a fold line 37*b*. The triangular shaped first bottom-end closure panel 24*b*/26*b* has a base defined by fold line 37*b*; and an apex. The apex of the first bottom-end closure panel 24*b*/26*b* is defined by a rounded, curved portion in the region of where the opposed edges of the first bottom-end closure panel 24*b*/26*b* would converge together.

First and second upstand flaps 28, 30 are connected to the opposite edges of the first bottom-end closure panel 24*b*/26*b* by means of hinge connections 21, 23. The first and second upstand flaps 28, 30 are not necessarily co-extensive with the full-length of the edges of the first bottom-end closure panel 24*b*/26 to which they are respectively attached. In other words, the upstand flaps 28, 30 do not necessarily extend between the base 37*b* and apex. Preferably, a short length of each of the opposed edges of the first bottom-end closure panel 24*b*/26*b*, is free of connection to an upstand flap 28, 30. The short length that is free of connection to an upstand flap 28, 30 is closer to the base 37*b* of the triangular first bottom-end closure panel 24*b*/26*b* than it is to said apex.

In the region of the apex of the first bottom-end closure panel 24*b*/26*b* (where fold lines 21, 23 would have converged were it not for the inclusion of the convex-rounding), the first and second upstand flaps 28, 30 are optionally rounded in shape. Accordingly, the ends of the first and second upstand flaps 28, 30, in the region of said apex, do not meet and the rounded ends of each first and second upstand flaps 28, 30, together with the convexly-rounded apex, form an undulated portion. This shaping may be beneficial in the assembly of a tubular carrier 90, which involves folding the upstand flaps 28, 30 about hinge connections 21, 23 (see below).

For facilitating the formation of a flat-form collapsed carrier (see FIG. 7); the first side panel and its associated first bottom-end closure panel 24*b*/26*b* comprise a medial fold line 17/27.

For holding the carrier 90 in an assembled condition, the first bottom-end closure panel 24*b*/26*b* is provided with first and second locking tabs T1, T2. Optionally, the first and second locking tabs T1, T2 are generally rectangular in shape; are formed as integral extensions of the first and second locking tabs T1, T2; and interrupt the hinge connections 21, 23. In a set-up carrier, the first and second locking tabs T1, T2 remain in the same plane as the first bottom-end closure panel 24*b*/26*b*, whereas the first and second upstand flaps 28, 30 are folded out of the plane of the first bottom-end closure panel 24*b*/26*b*. In this way, the first and second locking tabs T1, T2 jut-out beyond a notional foot-print of the bottom wall 24*b*/26*b*/20*b*/32/22 (defined by the main side panels 12, 14, 16) for engagement with locking slots S1, S2. See below for the description of the locking slots S1, S2 and see FIG. 12 for an illustration of the engagement of locking tab T1 in locking slot S1.

The second bottom-end closure panel 20*b*/32 is hinged to the second side panel 14 by a fold line 35*b*. The second bottom-end closure panel 20*b*/32 comprises a first section 20*b*; and a second section 32. The first and second sections 20*b*, 32 are adjoined together by means of a fold line 25.

The fold line 35*b* is interrupted by a first locking slot S1. The first locking slot S1 is optionally formed as a score or cutline, inset inwardly, just off the fold line 35*b*. The first locking slot S1 is sized and positioned such that in the set-up carrier 90, the first locking tab T1 can be received therein for holding the carrier 90 in an assembled condition. Accordingly, and as shown in FIG. 1, to ensure that the first locking tab T1 and first locking slot S1 can engage, the first locking tab T1 may have a width that is just smaller than a width of the first locking slot S1. Additionally, the first locking tab T1 is located at a distance away from the intersection of fold lines 15 and 37*b*/35*b*, along the hinge connection 23, that is similar to or the same as the distance away from the intersection of fold lines 15 and 37*b*/35*b*, along the hinge connection 35*b* at which the first locking slot S1 is located.

The fold line 25 that divides the second bottom-end closure panel 20*b*/32 into a first section 20*b*; and a second section 32, is angled such that the first section 20*b* as a generally triangular shape for defining an outermost part of the composite bottom wall 24*b*/26*b*/20*b*/32/22. The second section 32 can be folded about that fold line 25 for forming a securing panel to be used to attach the second section 32 of the second bottom-end closure panel 20*b*/32, to the third bottom-end closure panel 22*b*.

The third bottom-end closure panel 22*b* is hinged to the third side panel 12 by a fold line 33*b*. The fold line 33*b* is interrupted by a second locking slot S2. The second locking slot S2 is optionally formed as a score or cutline, inset inwardly, just off the fold line 33*b*. The second locking slot S2 is sized and positioned such that in the set-up carrier 90, the second locking tab T2 can be received therein for holding the carrier 90 in an assembled condition. Accordingly, and as shown in FIG. 1; to ensure that the second locking tab T2 and second locking slot S2 can engage; the second locking tab T2 may have a width that is just smaller than a width of the second locking slot S2. Additionally, the second locking tab T2 is located at a distance away from the intersection of fold lines 18 and 37*b*, along the hinge connection 21, that is similar to or the same as the distance away from the intersection of fold lines 13 and 35*b*/33*b*, along the hinge connection 33*b* at which the second locking slot S2 is located.

For closing the openable-top-end of the assembled carrier 90, a series of top-end closure features are provided. A first top-end closure feature is provided by the first side panel 16*a*/16*b*, in the form of a substantially triangular extension of the first side panel 16*a*/16*b*. The first top-end closure feature provided by the first side panel 16*a*/16*b* optionally has a rounded end as shown (at the end of fold line 17). The first top-end closure feature also comprises a first part A1 of a multi-part mechanical locking mechanism A1/N1/N2, in the form of a locking aperture A1. The aperture A1 in the arrangement of FIG. 1 is substantially elliptical in shape. In other embodiments, the first part A1 of the multi-part mechanical locking mechanism A1/N1/N2 may take different forms; and where it is in the form of a locking aperture, shapes other than substantially elliptical may be used, for example, but without limitation, the aperture may be oval, circular, curvilinear, irregular, triangular, square, polygonal.

The series of top-end closure features further comprises a second top-end closure panel 20*a*, a first handle panel 34, a third top-end closure panel 22*a* and a second handle panel 36. In the present arrangement the second top-end closure panel 20*a* and first handle panel 34; are similar in form and arrangement to the third top-end closure panel 22*a* and second handle panel 36 respectively; albeit mirror images of one another. This, optionally provides a degree of symmetry in the completed carrier 90.

As shown in FIG. 1, the second and third top-end closure panels 20*a*, 22*a* are each triangular in shape. Their combined area at least substantially, if not exactly, matches the area of a triangle bounded by the first, second, and third side panels 16*b*/16*a*, 14, 12 (i.e. the size of the open-top of carrier 90 once assembled). Optionally, and to achieve aesthetic symmetry, the area of each of the second and third top-end closure panels 20*a*, 22*a* are equal to each other. In other words, each of the second and third top-end closure panels 20*a*, 22*a* covers an equal half of the open top of the carrier. It will be recognized that in other arrangements of blank for forming a carrier, that one of the second and third top-end closure panels 20*a*, 22*a* may cover a greater area of an open-top of a carrier formed therefrom and that as a consequence of that, adjustments may need to be made to the associated first and second handle panels 34, 36.

Referring back to FIG. 1, the second top-end closure panel 20*a* is hinged to an upper edge of second side panel 14 by means of a fold line 35*a*. Third top-end closure panel 22*a* is hinged to an upper edge of third side panel 12 by a fold line 33*a*. Upper edges of the second and third top-end closure panels 20*a*, 22*a* are hinged to the first and second handle panels 34, 36 by hinged connections in the form of fold lines 29, 31.

The first handle panel 34 comprise a second part N2 of the multi-part mechanical locking mechanism A1/N1/N2 which is provided for holding the assembled carrier 90 in a closed condition (see FIGS. 11 and 12). The second part N2 of the of the multi-part mechanical locking mechanism A1/N1/N2 is a locking part for interconnection with the locking aperture A1. Optionally, the second part N2 is provided as hooked appendage N2 to the first handle panel 34. The hooked-appendage N2 may also be referred to as simply hook, or hooked-portion, catch, latch and as shown may be provided as slightly curved leg integrally formed with and extending from an edge of the first handle panel 34.

The first handle panel 34 also comprises a handle H1. Carrying handles are well-known in the field of folding cartons and it will be recognized that the carrying handle H1 shown may be replaced or substituted for a variety of suitable alternatives (for example the handles shown in FIGS. 13, 14 and 15). Optionally, the handle H1 starts within the first handle panel 34 spaced from each of opposed edges of the first handle panel 34 and proximate to, but spaced from the hook N2. Optionally, the handle H1 terminates on the fold line 29. The handle H1 comprises a fold line or hinged connection 60 and a cut or perforate line which defines a cushioning flap 62. The cushioning flap 62 is hinged by the hinge connection 60 to the first handle panel 34 and, in-use, can be moved out of the plane of the first handle panel 34, to either side of the first handle panel 34, so that a user of the carrier 90 can partially insert their fingers and/or hand into a handle aperture (not shown) thereby formed.

In very similar format to the first handle panel 34, albeit in mirror image thereof, the second handle panel 36 is provided. The second handle panel 36 comprises a third part N1 of the of a multi-part mechanical locking mechanism A1/N1/N2 which is provided for holding the assembled carrier 90 in a closed condition (see FIGS. 11 and 12). The third part N1 of the multi-part mechanical locking mechanism A1/N1/N2 is a locking part for interconnection with the locking aperture A1. Optionally, the third part N1 is provided as hooked appendage N1 to the second handle panel 36. The hooked-appendage N1 may also be referred to as simply hook, or hooked-portion, catch, or latch and as shown may be provided as slightly curved leg integrally formed with and extending from an edge of the second handle panel 36.

The second handle panel 36 also comprises a handle H2. Carrying handles are well-known in the field of folding cartons and it will be recognized that the carrying handle H2 shown may be replaced or substituted for a variety of suitable alternatives (for example the handles shown in FIGS. 13, 14 and 15). Optionally, the handle H2 starts within the second handle panel 36 spaced from each of opposed edges of the second handle panel 36 and proximate to, but spaced from the hook N1. Optionally, the handle H1 terminates on the fold line 31. The handle H1 comprises a fold line or hinged connection 60 and a cut or perforate line which defines a cushioning flap 62. The cushioning flap is hinged by the hinge connection 60 to the second handle panel 36 and, in-use, can be moved out of the plane of the first handle panel 34, to either side of the second handle panel 36, so that a user of the carrier 90 can partially insert their fingers and/or hand into a handle aperture (not shown) thereby formed.

Turning to the construction of the carrier 90 (illustrated in FIGS. 11 and 12), the carrier 90 may be formed by a series of sequential folding and adhering operations (shown in FIGS. 2 to 10) in a straight-line machine so that the carrier 90 may not be required to be rotated or inverted to complete its construction. The folding process is not limited to that described below and may be altered according to particular manufacturing requirements.

Figure 2:
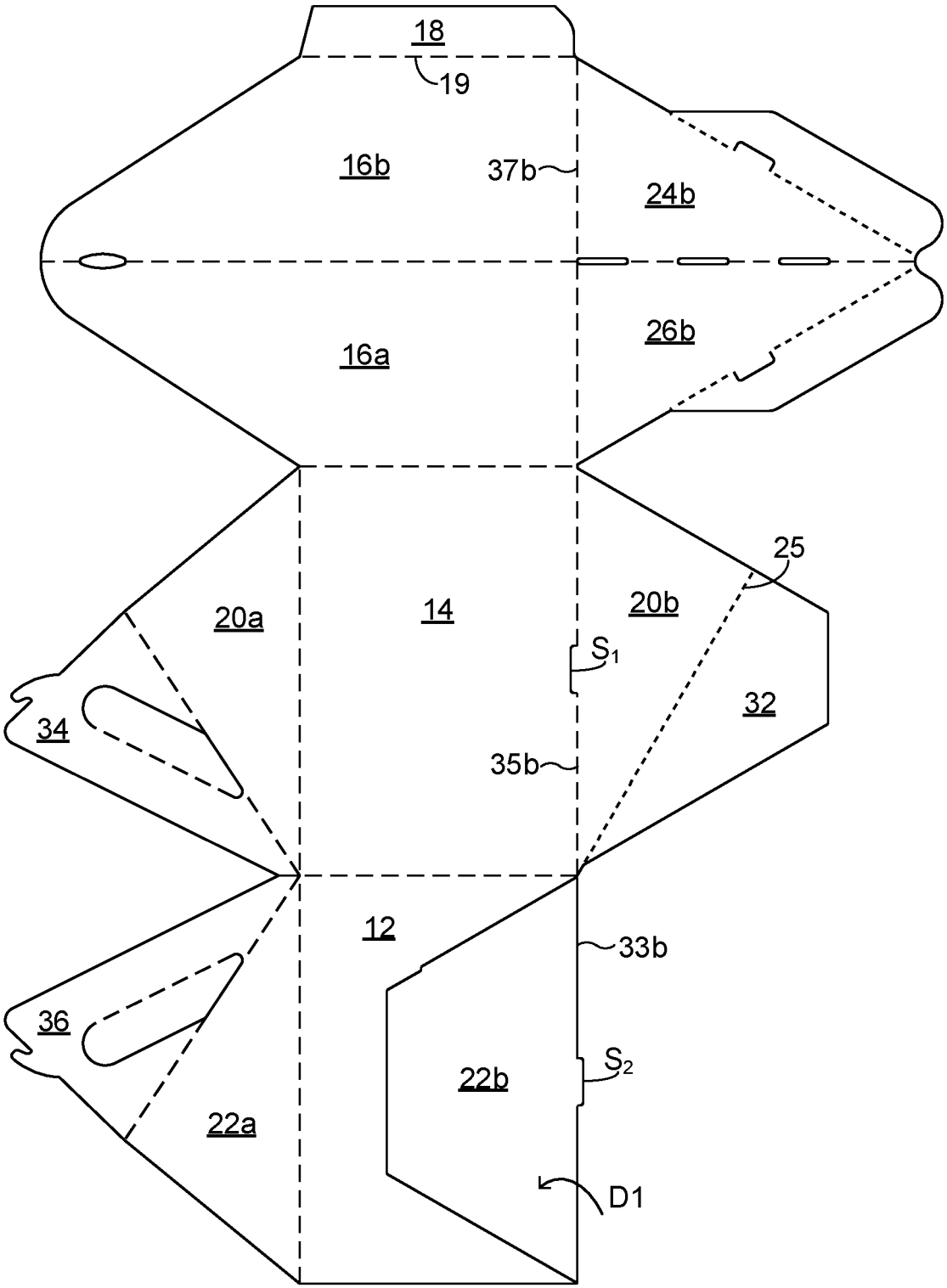
FIGS. 2 to 6 are plan views from above of the blank of FIG. 1 illustrating an optional folding and gluing sequence for forming a flat collapsed carrier from the blank.
Figure 3:
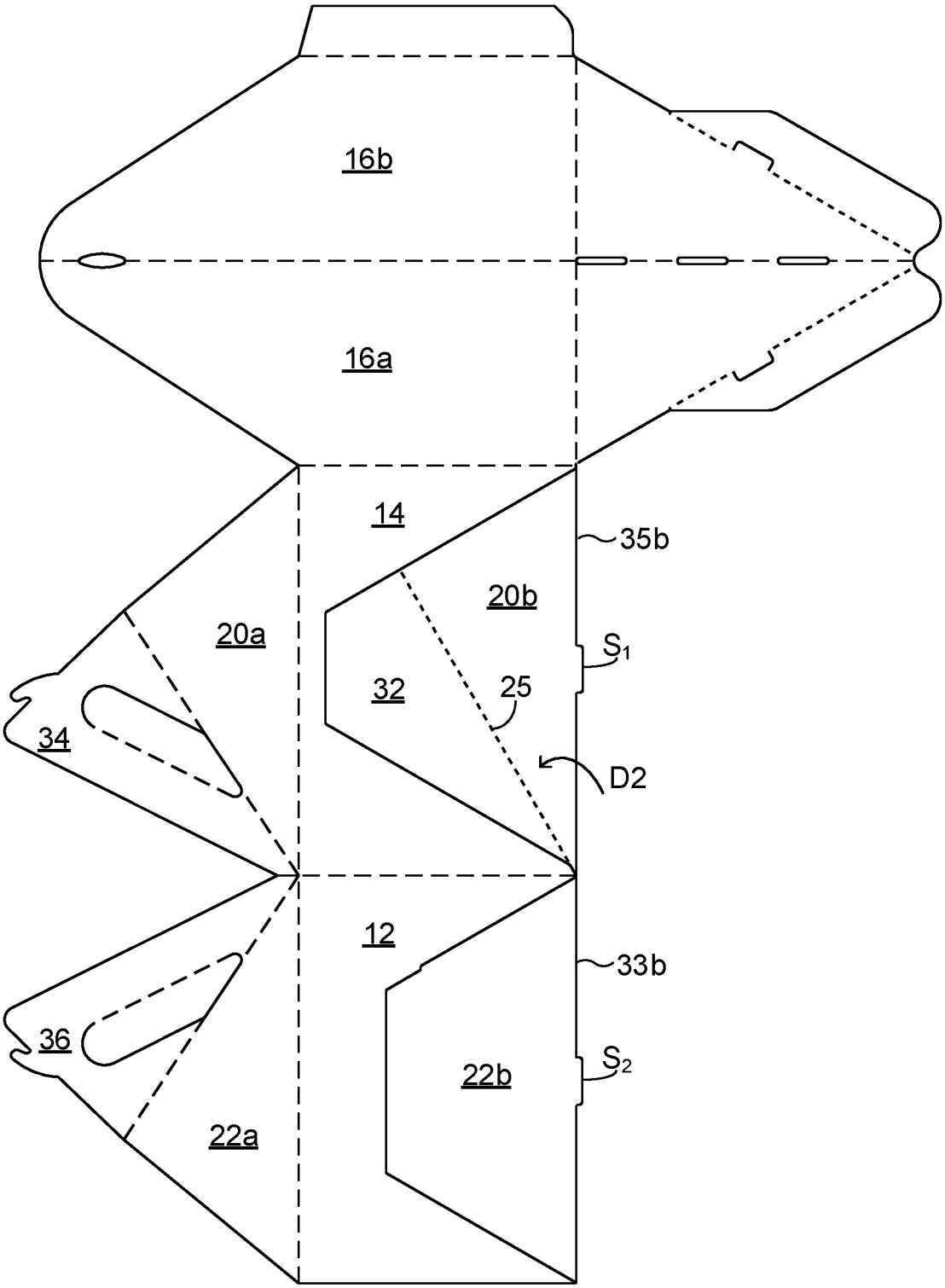

Referring now to FIG. 2, the third bottom-end closure panel 22*b* is folded about fold line 33*b*, in the direction indicated by reference D1 in FIG. 2, so that it is brought into face-to-face contacting relationship with at least a portion of an inside surface of the third side panel 12.

Figure 4:
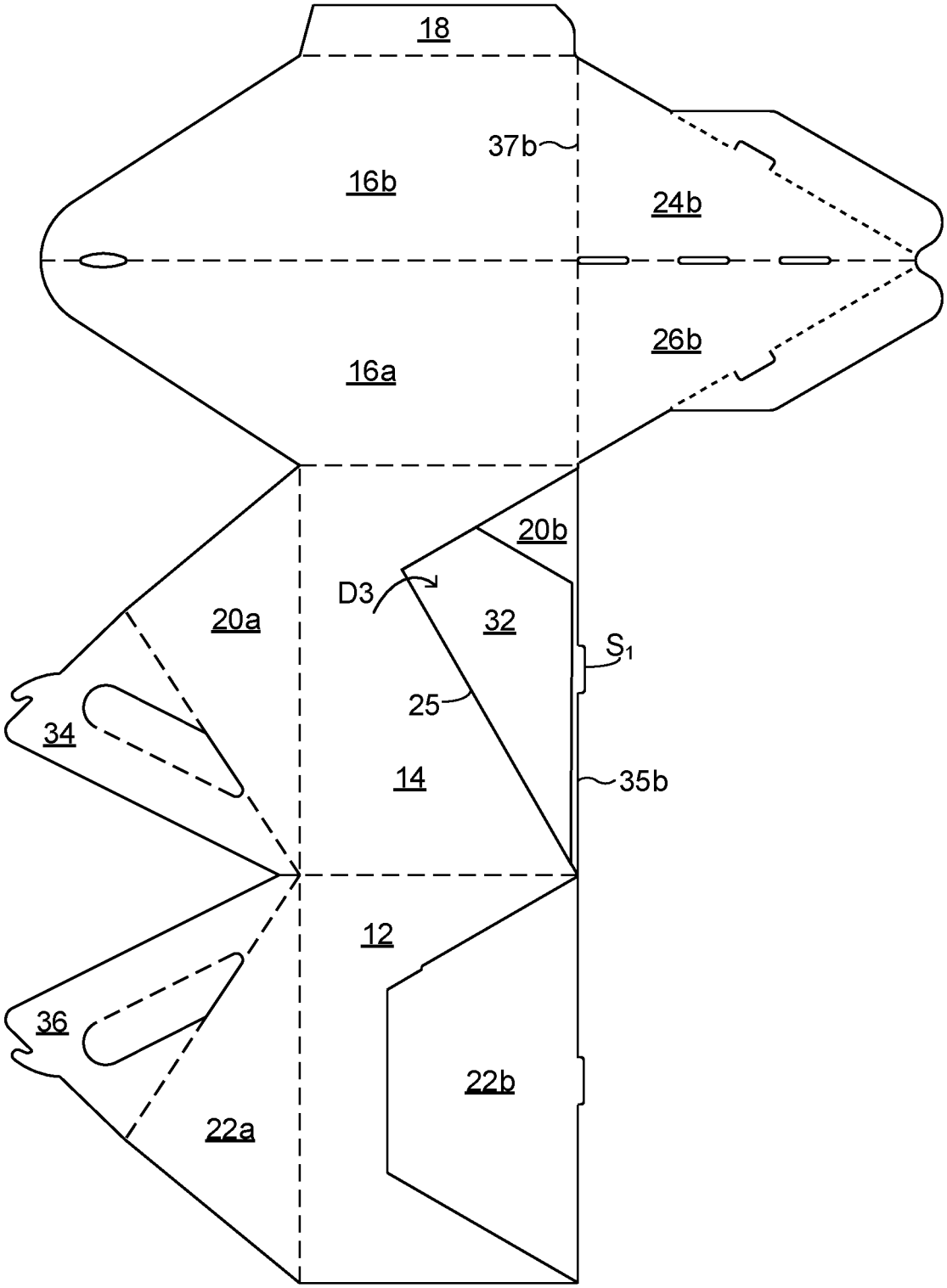

Similarly, the second bottom-end closure panel 20*b*/32 is folded about fold line 35*b*, in the direction indicated by reference D3 in FIG. 4, so that it is brought into face-to-face contacting relationship with at least a portion of an inside surface of the second side panel 14. The second section 32 of the second bottom-end closure panel 20*b*/32 is hinged about fold line 25, in the direction indicated by reference D3 in FIG. 4, so that an outside surface of the second section 32 is brought into face-to-face contacting relationship with an outside surface of the second side panel first section 20*b*.

Figure 5:
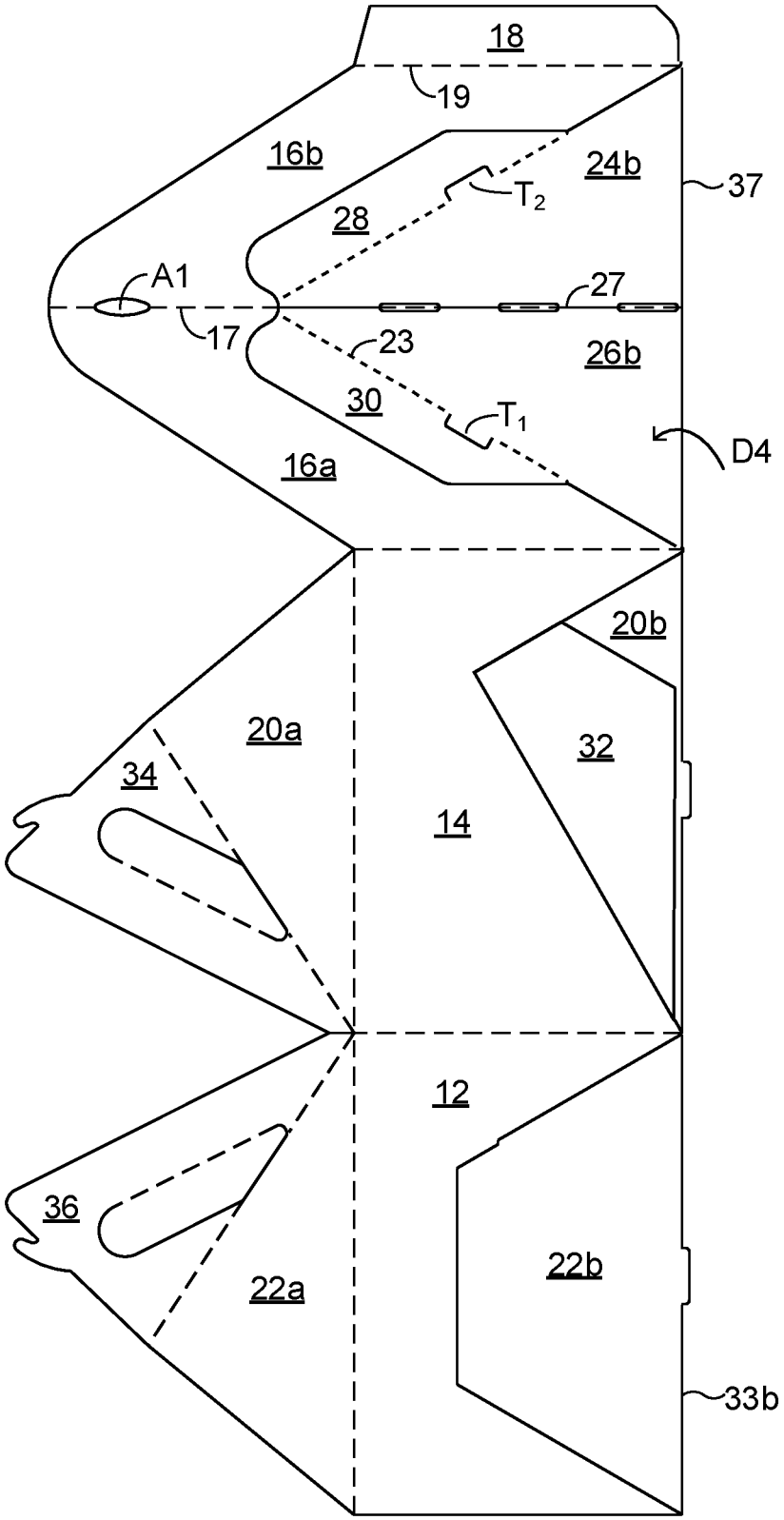

The first bottom-end closure panel 24*b*/26*b*, together with the first and second upstand flaps 28, 30, is folded about fold line 37*b*, in the direction indicated by reference D4 in FIG. 5, so that it is brought into face-to-face contacting relationship with at least a portion of an inside surface of the first side panel 16*a*/16*b*.

The first side panel 16*a*/16*b*, together with the securing panel 18; first bottom-end closure panel 24*b*/26*b*; and first and second upstand flaps 28, 30, is folded about fold line 17. In this way: a first section 16*b* of the first side panel 16*a*/16*b* overlies a second section 16*a* of the first side panel 16*a*/16*b*; a first section 24*b* of the first bottom-end closure panel 24*b*/26*b* overlies a second section 26*b* of the first bottom-end closure panel 24*b*/26*b*; the first upstand flap 28 overlies the second upstand flap 30; and the folded first bottom-end closure panel 24*b*/26*b* and upstand flaps 28, 30 are sandwiched between the first and second sections of the folded first side panel 16*a*/16*b*.

Figure 6:
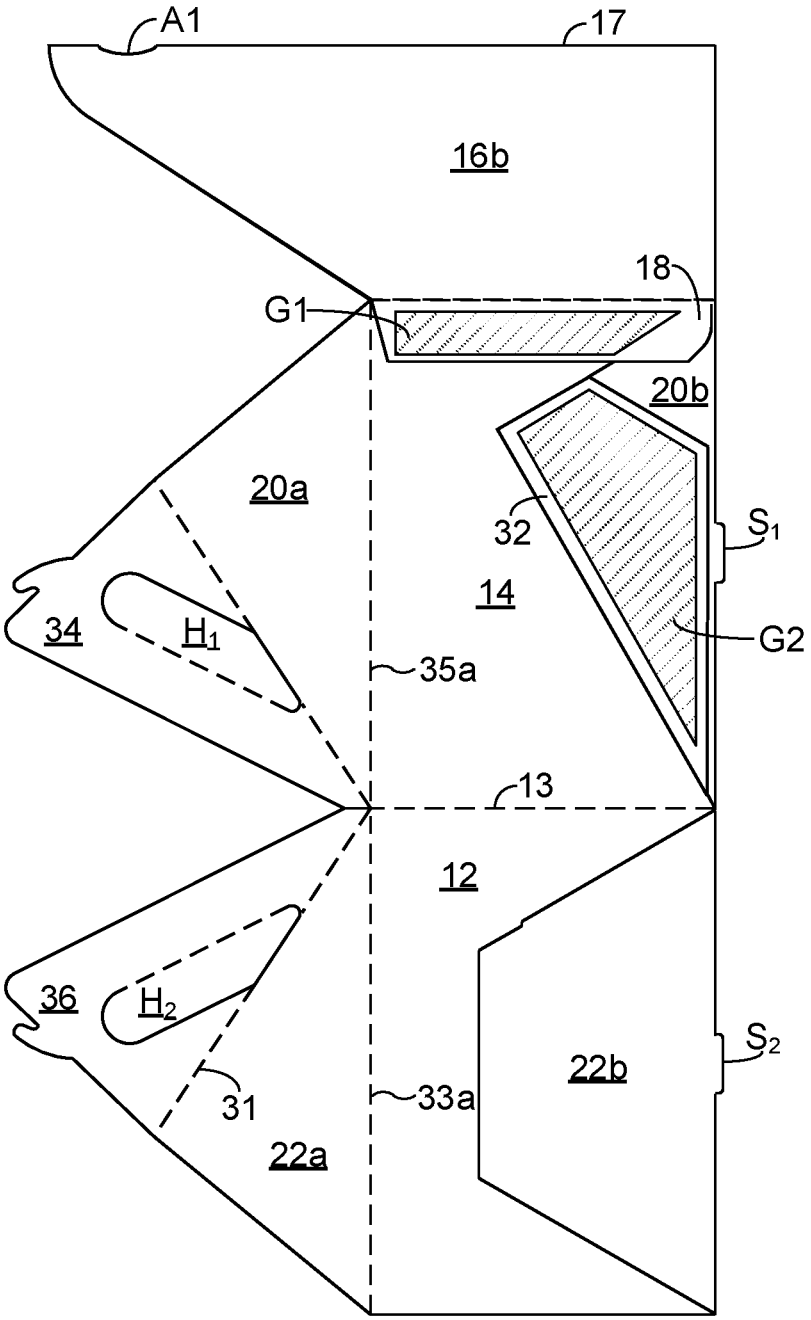

Additionally, an inside surface of the securing panel 18 is brought into face-to-face contacting relationship a portion of an inside surface of the second side panel 14 and a portion of an outside surface of the first section 20*b* of the second bottom-end closure panel 20*b*/32 (see FIG. 6).

Glue G1, G2 or other adhesive treatment may be applied to regions of outer surfaces of the securing panel 18 and second section 32 of the second bottom-end closure panel 20*b*/32 (see FIG. 6).

Figure 7:
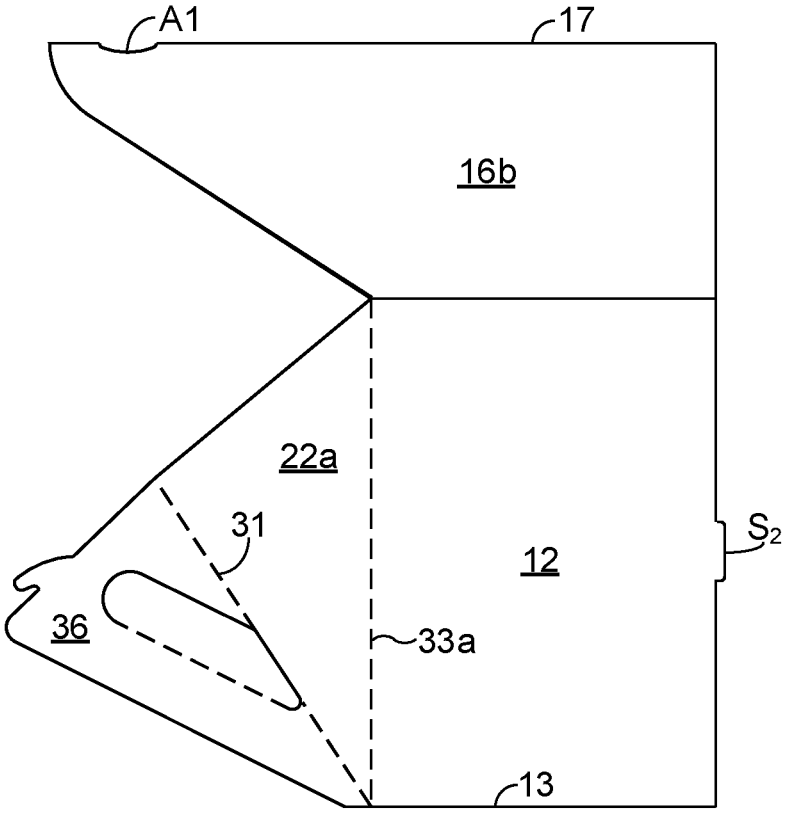
FIG. 7 is a plan view from above of the flat collapsed carrier formed from the blank of FIG. 1.
Figure 8:
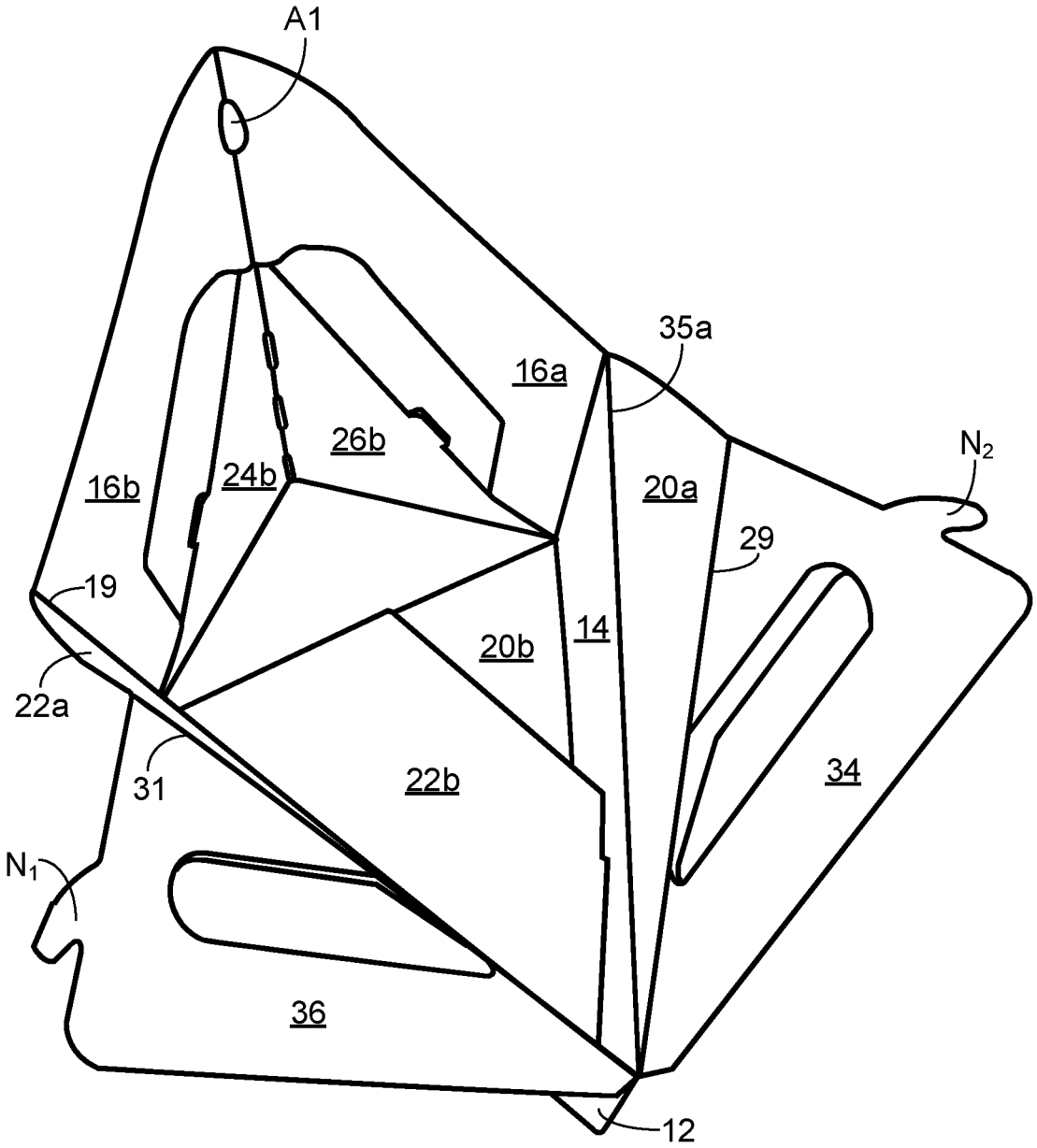
FIGS. 8 to 10 are perspective views from above of a carrier being opened and assembled from the flat collapsed form of carrier illustrated in FIG. 7.
Figure 9:
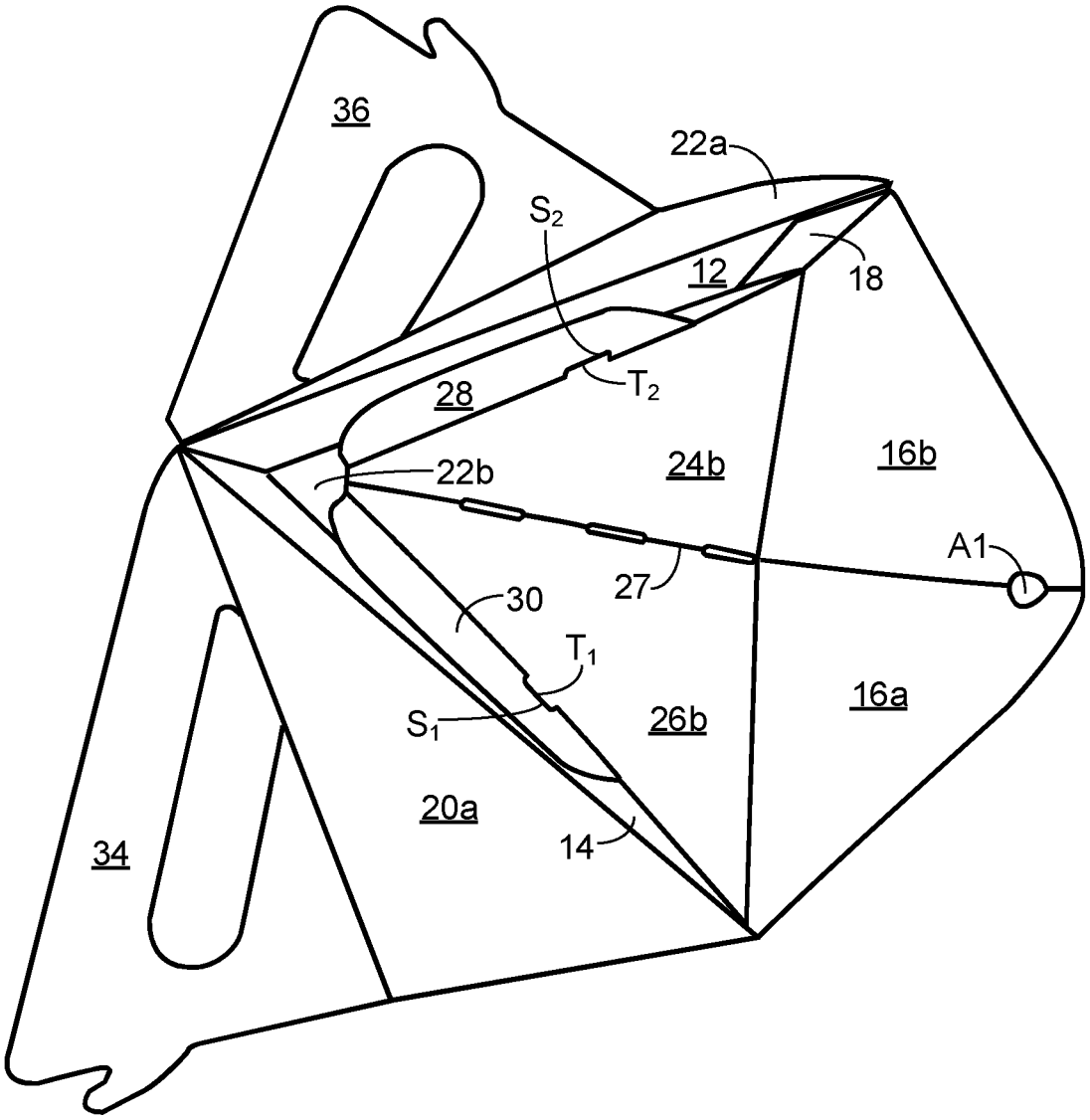

The third side panel 12, together with the third top-end closure panel 22*a* and second handle panel 36, is folded about fold line 13 such that: a portion of securing panel 18 is affixed to a portion of an inside surface of the third side panel 12; and a portion of third bottom-end closure panel 22*b* is affixed to the second section 32 of the folded-over second bottom-end closure panel 20*b*/32. (In alternative embodiments glue or other adhesive treatment may applied to the appropriate regions of the inside surface of the third side panel 12 and third bottom-end closure panel 22*b*.) In this way a flat collapsed tubular structure is formed as shown in FIG. 7.

The flat collapsed carrier can be readily shipped or distributed in the flat condition. In dependence upon the application for the carrier 90, the flat collapsed carrier may be transported to a plant for erecting and loading with primary product containers, such as a bag for a beverage; or directly to a food outlet, or the like, as appropriate.

The flat collapsed carrier can be easily and quickly assembled into an open-topped container 90 having a tubular structure of triangular cross-section and a composite crash-bottom-style, bottom wall 24*b*/26*b*/20*b*/32/22. This can be done by pushing folded edges 17, 13 towards one another. This action forces the fold lines 15 and 19 away from each other. The second side panel 14 and adjoining second section 16*a*/16*b* are folded relative to one another (about fold line 15). The third side panel 12 and adjoining first section 16*b* of the first side panel 16*a*/16*b* are folded relative to one another (about fold line 19). As the second and third side panels 12, 14 are moved away from each other, the first side panel 16*a*/16*b* begins to unfold (about fold line 17 (see FIG. 8). An outer layer of the crash-bottom style bottom wall is automatically un-folded and begins to assembled itself as the second and third side panels 12, 14 are moved away from each other (also see FIG. 8).

To complete assembly of the carrier 90, the first bottom-end closure panel 24*b*/26*b* together with first and second upstand flaps 28, 30, is folded about fold line 37*b*, inwardly and downwardly of the carrier 90. As the first and second upstand flaps 28, 30 begin to contact the second and third side panels 14, 12, they are forced to fold upwardly relative to the first bottom-end closure panel 24*b*/26*b* (see FIG. 9). As the first bottom-end closure panel 24*b*/26*b* comes to rest in flat form on top of the outer layer of the crash-bottom style bottom wall 20*b*/32/22*b*, to form an inner layer of the composite crash-bottom-style, bottom wall 24*b*/26*b*/20*b*/32/22, the first and second locking tabs T1, T2 are forced into engagement with respective ones of the first and second locking slots S1, S2. Once the first and second locking tabs T1, T2 are engaged with respective ones of the first and second locking slots S1, S2, the carrier 90 is completely assembled and is in an open-condition. See FIG. 10.

Loading or one or more articles into the carrier 90 can then take place. To securely close the carrier 90, the second and third top-end closure panels 20*a*, 22*a* are each folded relative to their associated side panel 14, 12; and relative to their associated handle panel 34, 36, about fold lines 35*a*, 33*a* and 29, 31 respectively. The action of drawing together the first and second handle panels 34, 36, whist at the same time applying a downward and inward force onto the second and third top-end closure panels 20*a*, 22*a*, urges the second and third top-end closure panels 20*a*, 22*a* to come together, in the same plane, such that their folded edges 35*a*, 33*a* meet, (optionally in the centre of the carrier 90), and create a top-wall 20*a*/22*a* that completely closes the carrier 90. Once the first and second handle panels 34, 36 have been fully drawn together, such that an inside surface of the first handle panel 34 is brought into face-to-face contacting relationship with the inside surface of the second handle panel 36, the multi-part mechanical locking mechanism A1/N1/N2 can be deployed to secure, lock or otherwise maintain the carrier 90 in the closed condition. The multi-part mechanical locking mechanism A1/N1/N2 is readily deployed by drawing the first top-end closure feature provided by the first side panel 16*a*/16*b* towards the abutting first and second handle panels 34, 36, such that the first part A1 of a multi-part mechanical locking mechanism A1/N1/N2 can be interlocked with the second and third parts N2, N1 of the multi-part mechanical locking mechanism A1/N1/N2. In this arrangement, that is achieved simply by locating the aperture A1 onto the hooks N1, N2. As an edge of the aperture A1 is caught on and hooked onto the hooks N1, N2, a deliberate force is required to remove the aperture, off the hooks N1, N2 for re-opening the carrier 90 (see FIG. 11).

It will be recognised that that the carrier 90, in having a multi-part mechanical locking mechanism A1/N1/N2, is configured to be re-closable and as such can be re-used. For example, in a beverage plant, the carrier 90 may be loaded with a bag, pouch or other flexible primary package containing a beverage, and the carrier closed by interlocking the first, second and third parts of the multi-part mechanical locking mechanism A1/N1/N2. In this loaded and closed form, the carrier 90 may be transported to a point-of-sale, purchased by a consumer and opened. Part of the loaded product may be consumed, and the consumer can then re-close the carrier 90 to again securely contain the part-consumed primary product within the carrier 90. This process can be repeated until the carrier 90 is empty; at which point the consumer may re-use the carrier for another purpose or take the appropriate steps for the carrier 90 to be recycled.

Similarly, if the carrier 90 is assembled in, for example, an outlet for baked goods, it can be loaded with a customer's specific order, for example three bagels; and securely closed at the point of purchase. The purchased goods are protected by the carrier 90; well supported by the multi-layered bottom wall 24*b*/26*b*/20*b*/32/22; and, in the case of round bagels, protected from damage due to the triangular cross-sectional shape of the carrier 90 which helps to snuggly contain such goods. Again, the customer can open the carrier, consume part of the product contained therein and securely re-close the carrier 90 to preserve product freshness and protect against contamination.

The carrier 90 is beneficially easily carrier by pushing the pair of cushioning flaps, together as a two-ply cushion out of the plane of the first and second handle panels 34, 36 (See FIG. 12).

Figure 13:
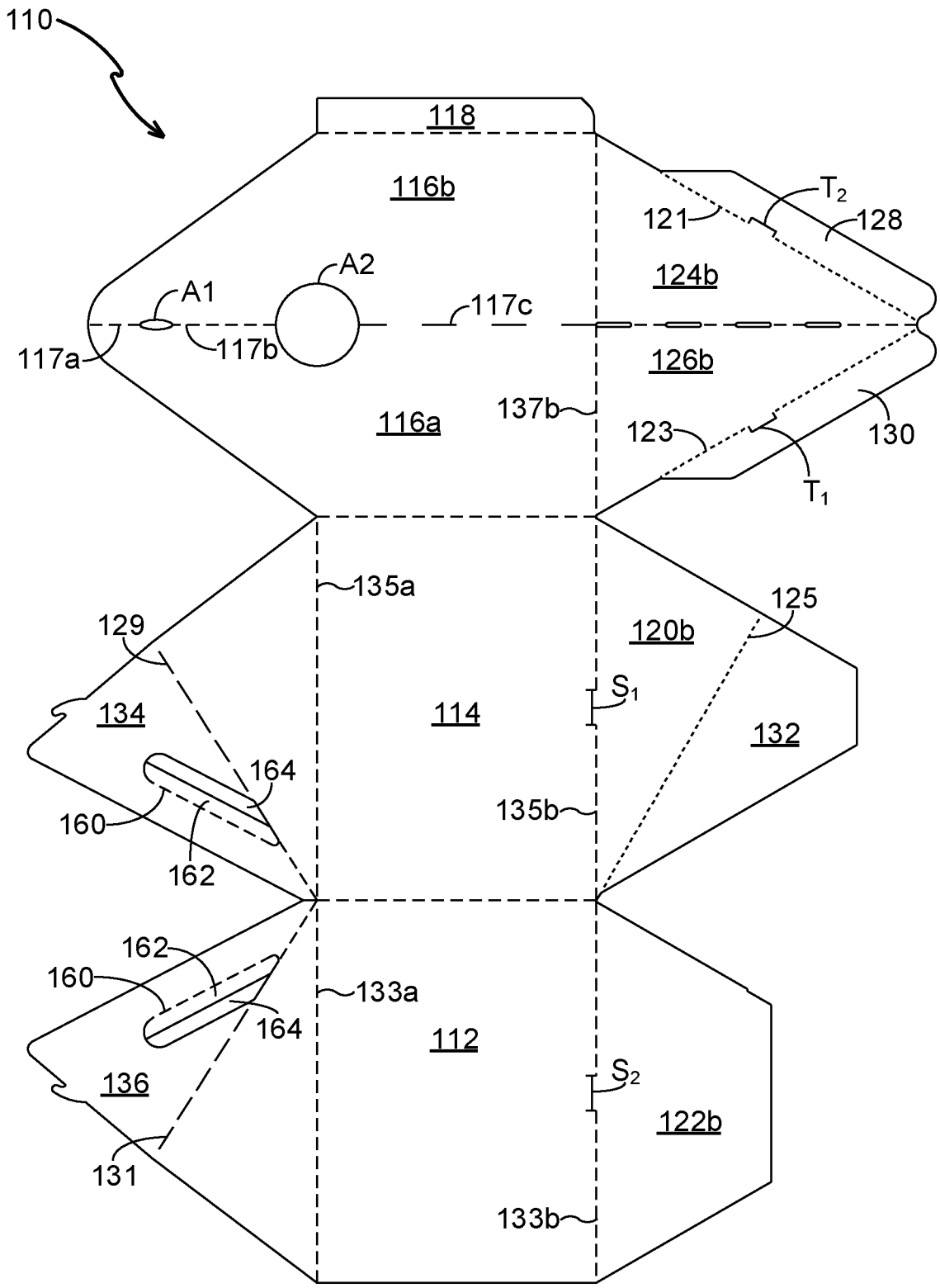
FIGS. 13, 14 and 15 are plan views from above of blanks for forming carriers according to further embodiments of the disclosure.
Figure 14:
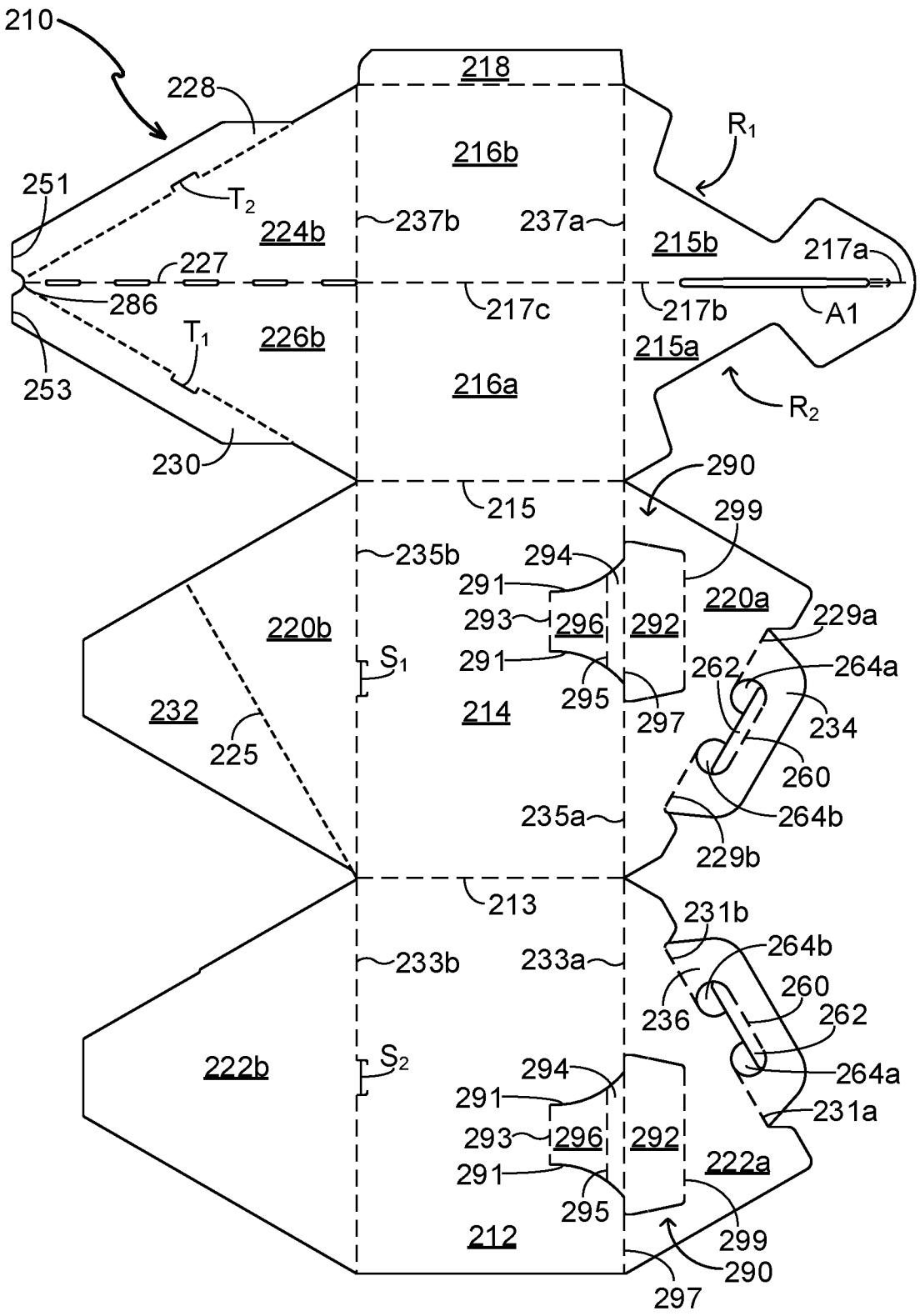
Figure 15:
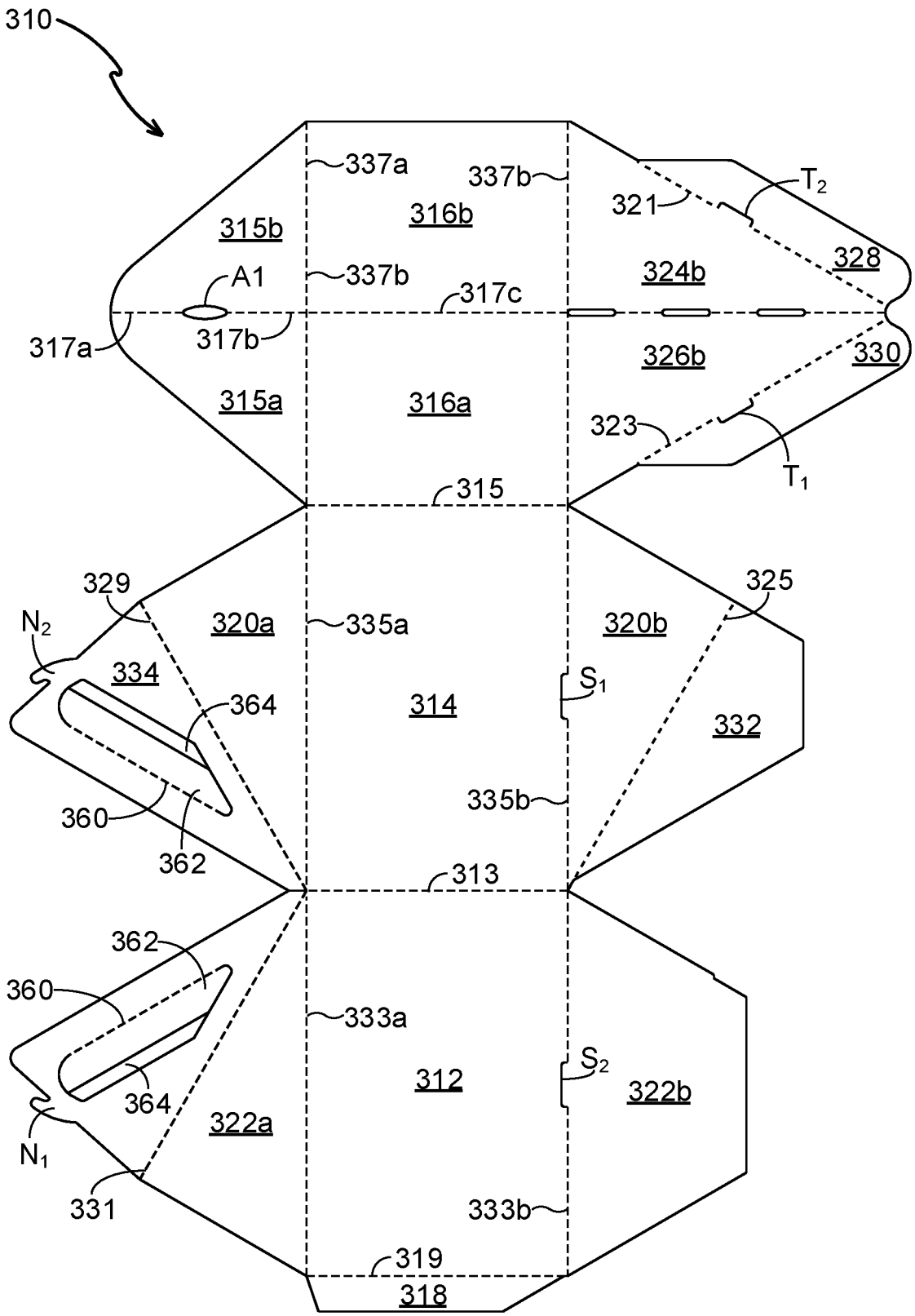

Referring now to FIGS. 13, 14 and 15, there are shown alternative embodiments. In the second, third and fourth illustrated embodiments like numerals have, where possible, been used to denote like parts, albeit with the addition of the prefix "100", "200" and "300" respectively, to indicate that these features belong to the second, third and fourth embodiments. The alternative embodiment shares many common features with the first embodiment, and therefore only the differences from the embodiment illustrated in FIGS. 1 to 13 will be described in any detail.

In FIG. 13 it can be seen that a fold line 117*a*/117*b*/117*c* in the first side panel 116*a*/116*b* of blank 110 is interrupted by both the first part A1 of the multi-part mechanical locking mechanism A1/N1/N2 and by an aperture A2. The aperture A2 is optionally circular in shape Optionally, a centre of the aperture A2 is co-incident with an intersection of: a first notional line running through fold line 117*a*/117*b*/117*c*; and a second notional line running though the fold lines 135*a* and 133*a*.

Beneficially, in some applications, the aperture A2 may be provided for receiving therethrough, a spout of a primary container, for example, pouch containing a beverage such as a wine, juice, beer, coffee or the like. In some applications, a spout on a container may be placed through the aperture A2; and a cap then attached to the spout such that the capped spout is held in position. Other features on a spout closure may alternatively be utilized to securely hold the spout and its cap in a location where the spout (and cap) extends through the aperture A2. Assembled in this way, a carrier formed from the blank 110 and loaded with a spouted beverage pouch (not shown), can be additionally utilized as a handy pouring device. The handle structure being located directly behind and in alignment with the spout enables a user to pour a beverage or other fluid out of the internally disposed primary package. Such a beverage pouch may be loaded with a hot drink at a point of sale unit by a server; and loaded into the carrier before or after filling. The pouch may be filled while the pouch and its spout are in-situ, (loaded into the carrier), and the pouch may be loaded with a customer's preferred hot beverage and then the spout capped. The composite, crash-bottom-style, bottom wall 124*b*/126*b*/120*b*/132/122 may be advantageous in such an application due to its solid construction and partially 3-ply construction which helps to ensure that an item, such as a hot beverage, when contained in the carrier is well supported, securely contained and to some degree insulated to maintain the temperature of the hot beverage during transport.

Additionally, or alternatively, the handles are defined by folds 160; cushioning flaps 162; and in this arrangement apertures 164, such that the cushioning flaps 162 are smaller in depth than the depth of the handle opening. The inclusion of the apertures 164 may make (initial) deployment of the carrying handle slightly easier for the consumer; and may facilitate the user operating the carrier as a pouring device.

In FIG. 14, the blank 210 is configured with a similar substantially triangular-shaped, composite, crash-bottom-style, bottom wall 224*b*/226*b*/220*b*/232/222 of solid construction to ensure that items, when contained in the carrier 90 are well supported, securely contained and protected against accidental egress. However, in this arrangement, an upper edge of the first side panel 216*a*/216*b* is defined by a fold line 237*a*; and the first top-end closure feature is provided by a more distinct first top-end closure panel 215*a*/215*b* which is hingedly connected to the first side panel 216*a*/216*b* by the fold line 237*a*. The first top-end closure panel 215*a*/215*b* has a very generally triangular perimeter with a rounded apex, albeit the opposed side edges have (optional) shaped recesses R1, R2. The recesses R1, R2 may be shaped for co-operation with one or more retaining features provided in either or both of: the second side panel 214 and second top-end closure panel 220*a*; and third side panel 212 third top-end closure panel 222*a*. The recesses R1, R2 may be three sided; having rounded internal and external corners; and slightly tapered side edges.

In this illustrated arrangement, the blank 210 is provided with two separate retaining features, a first retaining feature in the second side panel 214 and second top-end closure panel 220*a*; and a second retaining feature in the third side panel 212 and third top-end closure panel 222*a*. The first and second retaining features 290 are optionally of the same configuration and format, and are provided for aiding retention of an ancillary item (not shown). An ancillary item may, for example, be a paired accompaniment to the item(s) contained within the main interior of the carrier formed from the blank 210. In some baked goods outlets, it is popular to provide customers with a selection of flavoured spreadable accompaniments to accompany various types and flavor of baked goods. The flavoured spreadable accompaniments may be provided in rigid or semi-rigid pots. It may provide a pleasing and novel experience for a customer; as well as a practical and efficient packaging solution for a baked goods carrier to also hold one or more such accompaniments.

As the first and second retention features 290 for aiding retention of an ancillary item are the same, only one is described.

The first retention feature 290 provides a pocket, chamber or compartment for receiving therein an ancillary item. A first pocket panel 292 is hingedly connected by a fold line 299 to the second top-end closure panel 220*a*. The first pocket panel 292 is generally trapezoidal in shape, with tapered cut-side edges tapering away from the fold line 299 to the fold line 235*a*. The recess R2 (and recess R1) may have a similar shape to the shape of the first pocket panel 292. The first pocket panel 292 forms a back wall of a pocket in a set-up condition.

A second pocket panel 296 is hingedly connected by a fold line 293 to the second side panel 214. The second pocket panel 296 forms a bottom wall of the pocket in a set-up condition. A third pocket panel 294 is hinged between the first and second pocket panels 292, 296 by hinged connections in the form of fold and partial cut line 297 and fold line 295. First and second opposed side edges of the first pocket panel 292 (which link between the fold lines 299 and 297); are defined by cut lines (in other arrangements perforate/frangible lines may be used). First and second opposed side edges 291 of the second pocket panel 296 and third pocket panel 294 extend from the fold line 235*a*, optionally in a curved manner, to the fold line 293.

In a set-up condition, a top opening of first retention feature 290 (pocket) is formed by displacement of the first pocket panel 292 inwardly, downwardly, and substantially perpendicularly (or there about) to the second top-end closure panel 220*a*. In this way, the first pocket panel 292 forms the back wall of the pocket (not shown in assembled form). Displacement of the first pocket panel 292 inwardly may be limited and/or the pocket 290 is not restricted by the presence of the first-top end closure panel 215*a*/215*b* due to the inclusion of the recess R2.

A front opening of the pocket 290 is defined by displacing the second and third pocket panels 296, 294 inwardly, downwardly and substantially perpendicularly (or there about) to the second side panel 214. In this way the bottom wall of the pocket 290 is formed. The compartment thereby formed can be used for holding or retaining an ancillary item.

As an additional or alternative option, in this embodiment, each of the handles comprises a hinge connection 260; a cushioning flap 262 (hinged to the first and second handle panel 234, 236 by hinge connection 260); and two separate finger apertures 264*a*, 264*b* which are separated by a shaped piece of material to form a more aesthetically pleasing handle structure. The shaped piece of material may have a shape the is complimentary to, a shape associated with the branding of the product contained in the carrier. The first and second handle panels 234, 236 may have a more trapezoidal form compared to the generally triangular shaped first and second handle panels 34, 134, 36, 136 of the first and second illustrated blanks 10, 110. The first and second handle panels 234, 236 may hingedly connected to the second and third top-end closure panels 220*a*, 222*a* respectively by first and second spaced fold lines 229*a*; 229*b*, that are separated by said shaped piece of material. In this way, the handle structure can, if required, be folded into a flat form on top of the top wall formed by the first, second and third top-end closure panels 215*a*/215*b*, 220*a*, 222*b*.

In a set-up carrier, the fold line 237*a* facilitates the folding of the top-end closure panel 215*a*/215*b* on top of and into superposition with, the second and third top-end closure panels 220*a*, 222*a*. An elongate locking aperture A1 can be located over the first and second handle panels 234, 236, which first and second handle panels 234, 236 act as the second and third parts 234, 236 of a multi-part mechanical locking mechanism A1/234/236

Referring now to the embodiment illustrated in FIG. 15, it can be seen that the securing panel 318 is hingedly connected to the third side panel 312 in contrast to being hinged to the first side panel 316*a*; 316*b*. The folding and gluing sequence may be easier in some automated machines by having the blank 310 configured in this manner. Furthermore, the handles are defined by folds 360; cushioning flaps 362; and apertures 364; The inclusion of the apertures 364 may make (initial) deployment of the carrying handle slightly easier for the consumer. In view of this and/or for strengthening and/or aesthetic considerations, the handles terminate away from the fold lines 329, 331. As such the handles 360/362/364 are fully formed and enclosed within the body of the first and second handle panels 334, 336 respectively.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carrier for a food or beverage product, the carrier comprising first, second and third connected side panels which together define a three-sided tubular structure having a triangular cross-sectional shape, the carrier further comprising:

(i) a substantially triangular-shaped, crash-bottom-style, bottom wall for supporting one or more food or beverage products when contained in the carrier, a part of the bottom wall being directly coupled to each of the first, second and third side panels;

(ii) a mechanical interlocking feature for maintaining the bottom wall in a set-up condition;

(iii) a multi-part mechanical locking mechanism;

(iv) a first top-end closure panel comprising a first part of said multi-part mechanical locking mechanism;

(v) a second top-end closure panel and a first handle panel coupled thereto, comprising a second part of said multi-part mechanical locking mechanism; and (vi) a third top end closure panel and a second handle panel coupled thereto, comprising a third part of said multi-part mechanical locking mechanism, whereupon interconnection of said first, second and third parts of the multi-part mechanical locking mechanism, a top-end of the carrier is releasably secured into a closed and locked condition; and upon disconnection of said first, second and third parts of the multi-part mechanical locking mechanism, the carrier is released into an open-topped condition wherein access to the interior of the carrier is gained.

2. A carrier according to claim 1, wherein the bottom wall comprises: a first bottom-end closure panel hinged to the first side panel; a second bottom-end closure panel hinged to the second side panel; and a third bottom-end closure panel hinged to the third side panel.

3. A carrier according to claim 2 wherein, the third bottom-end closure panel is disposed outermost; wherein the second bottom-end closure panel is folded such that first and second sections of the second bottom-end closure panel overlay at least part of the third bottom-end closure panel with the second section being affixed to the third end closure panel; and wherein the first bottom-end closure panel is disposed innermost and overlays at least part of the second and third bottom-end closure panels.

4. A carrier according to claim 3, wherein a first part of said mechanical interlocking feature for maintaining the bottom wall in a set-up condition is provided by a first slot formed proximate to or within a hinged connection between the second bottom-end closure panel and the second side panel.

5. A carrier according to claim 4, wherein said first bottom-end closure panel has a generally triangular shape having a base defined by a hinged connection between the first bottom-end closure panel and the first side panel and wherein a first upstand flap is connected to a first edge of said first bottom-end closure panel.

6. A carrier according to claim 5, wherein a second part of said mechanical interlocking feature for maintaining the bottom wall in a set-up condition is provided by a first tab formed proximate to a hinged connection between the first bottom-end closure panel and the first upstand flap.

7. A carrier according to claim 6, wherein said first tab is engaged with the first slot and wherein the first upstand flap is disposed in face contacting relationship with an inside surface of the second side panel.

8. A carrier according to claim 7, wherein a third part of said mechanical interlocking feature for maintaining the bottom wall in a set-up condition is provided by a second slot formed proximate to or within a hinged connection between the second bottom-end closure panel and the second side panel.

9. A carrier according to claim 8, wherein a second upstand flap is connected to a second edge of said first bottom-end closure panel.

10. A carrier according to claim 9, wherein a fourth part of said mechanical interlocking feature for maintaining the bottom wall in a set-up condition is provided by a second tab formed proximate to a hinged connection between the first bottom-end closure panel and the second upstand flap.

11. A carrier according to claim 10, wherein said second tab is engaged with the second slot and wherein the second upstand flap is disposed in face contacting relationship with an inside surface of the third side panel.

12. A carrier according to claim 1, wherein said first part of the multi-part mechanical locking mechanism comprises an aperture.

13. A carrier according to claim 12, wherein said second part of the multi-part mechanical locking mechanism comprises a hooked portion formed as an appendage of the second top-end closure panel.

14. A carrier according to claim 13, wherein said third part of the multi-part mechanical locking mechanism comprises a hooked portion formed as an appendage of the third top-end closure panel.

15. A carrier according to claim 1 wherein, a first retention feature for retaining an ancillary item is provided as a pocket, defined by: a first pocket panel hingedly connected to the second top-end closure panel; a second pocket panel hingedly connected to the second side panel; and a third pocket panel hinged between the first and second pocket panels, wherein the first pocket panel provides a back wall of a pocket and wherein the second pocket panel forms a bottom wall of the pocket.

16. A carrier according to claim 15 wherein, the first pocket panel is generally trapezoidal in shape, with tapered edges and wherein a recess provided along an edge of the first top end closure panel has a similar shape and size to the shape and size of the first pocket panel.

17. A carrier according to claim 1 wherein, to facilitate the collapse of the formation of a flat-form collapsed carrier, the first side panel and its associated first bottom-end closure panel comprise a medial fold line.

18. A flat-form collapsed carrier formed from the carrier of claim 17, wherein said mechanical interlocking feature for maintaining the bottom wall in a set-up condition is disengaged; wherein said multi-part mechanical locking mechanism is disengaged; and wherein the carrier has been folded about said medial fold line.

19. A blank for forming a carrier suitable for containing a food or beverage product, the blank comprising first, second and third side panels for forming a three-sided tubular structure having a triangular cross-sectional shape, the blank further comprising:

(i) first, second and third bottom-end closure panels for forming a substantially triangular-shaped, crash-bottom-style, bottom wall, said first, second and third bottom-end closure panels being directly coupled to the first, second and third side panels respectively;

(ii) features for forming a mechanical interlocking feature for maintaining the bottom wall in a set-up condition;

(iii) features for forming a multi-part mechanical locking mechanism;

(iv) a first top-end closure panel comprising a first part of said multi-part mechanical locking mechanism;

(v) a second top-end closure panel and a first handle panel coupled thereto, comprising a second part of said multi-part mechanical locking mechanism; and (vi) a third top end closure panel and a second handle panel coupled thereto, comprising a third part of said multi-part mechanical locking mechanism, whereupon assembly of the blank into a carrier and upon interconnection of said first, second and third parts of the multi-part mechanical locking mechanism, a top-end of the carrier is releasably secured into a closed and locked condition; and upon disconnection of said first, second and third parts of the multi-part mechanical locking mechanism, the carrier is released into an open-topped condition wherein access to the interior of the carrier is gained.

* * * * *